US005920022A

United States Patent [19]

Ashwood, Jr.

[11] Patent Number: 5,920,022

[45] Date of Patent: Jul. 6, 1999

[54] MUSICAL INSTRUMENT WARMER

[76] Inventor: Henry Ashwood, Jr., 2858 Pallanza Dr. South, St. Petersburg, Fla. 33705

[21] Appl. No.: 08/980,322

[22] Filed: Nov. 28, 1997

Related U.S. Application Data

[63] Continuation-in-part of application No. 08/778,161, Jan. 10, 1997, abandoned, which is a continuation-in-part of application No. 08/646,549, May 8, 1996, abandoned.

[51] Int. Cl.[6] ..... G10D 7/10

[52] U.S. Cl. ..... 84/453; 84/387 R; 219/535; 219/528; 219/549; 219/201

[58] Field of Search ..... 84/453, 387 R, 84/385 R; 219/201, 221, 521, 523, 527, 528, 549, 535; 607/108, 109, 111, 112

[56] References Cited

U.S. PATENT DOCUMENTS 1,481,855 1/1924 Bach ..... 84/387 R 4,742,755 5/1988 Peterson ..... 84/453

*Primary Examiner*—William M. Shoop, Jr.
*Assistant Examiner*—Shih-yung Hsieh

[57] ABSTRACT

A musical instrument warmer including a horn in combination with a cover for warming. A warming means is positioned around the horn for heating. The warming means is provided with an electrical power source for activation. Whereby, providing power to the warming means raises the temperature of the warming means for heating the valves when temperatures being below 32° Fahrenheit. Lastly, the cover has a body member with a front side and a rear side. The body member is formed by attaching two layers of a fabric. The front side of the body member has a cone-like portion projecting outwardly. The body member is adapted to be removably mounted onto the horn when the heating means is positioned on the horn. The body member retains heat generated by the warming means therein, when the warming means is activated.

19 Claims, 12 Drawing Sheets

MUSICAL INSTRUMENT WARMER

This is a Continuation-In-Part of U.S. application Ser. No. 08/778,161 filed Jan. 10, 1997 now abandoned, which was a Continuation-In-Part of U.S. application Ser. No. 08/646,549 filed May 08, 1996 now abandoned. All subject matter set forth in application Ser. No. 08/778,161 and application Ser. No. 08/646,549 is hereby incorporated by reference into the present application as if fully set forth herein.

BACKGROUND OF THE INVENTION

1. Field of the Invention

The present invention relates to a musical instrument warmer and more particularly pertains to providing a covering for warming brass and woodwind type musical instruments in cold weather and further allowing playing of the instruments when covered by the musical instrument warmer.

2. Description of the Prior Art

The use of musical instrument heating is known in the prior art. More specifically, musical instrument heating heretofore devised and utilized for the purpose of warming an idle instrument are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,253,563 to Smith discloses a universal support apparatus for heating and supporting of a musical instrument. The Smith invention is structured to support one or more musical instruments and prevent damage thereto. The Smith invention will provide gentle heating during non-usage of the musical instrument that is supported on the mounting peg of a rotating base. U.S. Pat. No. 4,926,735 to Smith discloses a heated rotatable musical instrument stand. This Smith invention is also structured to support one or more musical instruments on a stand that includes a plurality of mounting stations. A platform and base have a heating chamber therebetween, with the base supporting the mounting stations. U.S. Pat. No. 4,529,865 to Oakes discloses an electrically heated musical instrument stand. The Oakes invention is an adjustable stand for supporting a single instrument during breaks or pauses during a performance. An thermostatically controlled heater is mounted atop an instrument support stem of the Oakes stand. Thus, although the two Smith inventions and the Oakes invention may be used to warm a brass and woodwind instrument, the devices are not portable and capable of warming the instrument during playing.

U.S. Pat. No. 4,742,755 to Peterson discloses a heating attachment for a musical instrument. The heating attachment, of Peterson, is for the mouthpiece of a musical wind instrument. The attachment has a sleeve and is used during outdoor playing of the instrument. Though Peterson addressed the problem of providing a warmed mouth piece, this prior art reference does not warm the body and bell of the instrument during playing and hence fails in maintaining the temperature of the instrument during normal playing time.

U.S. Pat. No. 5,172,683 to West discloses a stethoscope warmer. The West invention is a portable stethoscope warming device that incorporates an exothermic reaction heating element. The device comprises a first pouch member adapted to be used with both diaphragm type and bell type stethoscopes. The device has a second pouch member containing a chemical packet. Lastly, U.S. Pat. No. Des. 281,100 to Fluckiger discloses a portable electric heater. This invention is an ornamental design. The invention of West warms a idle stethoscopes by using a chemical reaction to provide exothermic heat in a small pouch. This heating device is totally unlike the heating elements of the present invention. Thus, there exist a need in the art for a musical instrument warmer which is portable, easy to construct and usable during playing of the instrument.

While these devices fulfill their respective, particular objectives and requirements, the aforementioned patents do not describe musical instrument warmer that allows the brass and woodwind class of musical instruments to be easily played in freezing temperature when covered by a device having a heating element positioned between the layers of the fabric.

In this respect, the musical instrument warmer according to the present invention substantially departs from the conventional concepts and designs of the prior art, and in doing so provides an apparatus primarily developed for the purpose of providing a covering for warming brass and woodwind type musical instruments in cold weather and further allowing playing of the instruments when covered by the musical instrument warmer.

Therefore, it can be appreciated that there exists a continuing need for a new and improved musical instrument warmer which can be used for as covering for warming brass and woodwind type musical instruments in cold weather and further allowing playing of the instruments when covered by the musical instrument warmer. In this regard, the present invention substantially fulfills this need.

SUMMARY OF THE INVENTION

In view of the foregoing disadvantages inherent in the known types of musical instrument heating now present in the prior art, the present invention provides an improved musical instrument warmer. As such, the general purpose of the present invention, which will be described subsequently in greater detail, is to provide a new and improved musical instrument warmer and method which has all the advantages of the prior art and none of the disadvantages.

To attain this, the present invention essentially comprises a brass horn in combination with a cover for warming. The brass horn has a mouthpiece at one end and a bell at another end and an intermediate portion with valves. The cover has a generally rectangular body member. The body member has a front side, a rear side and a generally rectangular projection along a top portion. The body member is formed by attaching two layers of a polymeric fabric. The front side of the body member has a cone-like portion projecting outwardly. The cone-like portion has a first portion that is integral the front side and the top portion. The cone-like portion has a free portion capable of allowing air to pass therethrough and into a hollow interior of the body member. The body member is adapted to be removably mounted onto the horn with a generally identical structure. The body member has a horizontal slit on one side and a vertical slit on another side for allowing playing of the horn. The cone-like portion is positioned about the bell of the horn, while allowing the operation of the horn. The rectangular projection is positioned over the valves of the horn while allowing the operation of the valves. A sleeve portion is included and positioned near the mouth piece. The sleeve portion has a first end and a second end integral the rear side of the body member and the top portion. The sleeve portion has a flap that opens and closes. The flap has a pile type fastener adjacent an interior edge. The flap has a pile type faster adjacent a complementary exterior edge and capable of coupling with the pile type fastener of the interior edge. Provided is an arm band. The arm band has an interior side and an exterior side with a housing fixedly attached. The housing has a source of electrical power located within. The housing has an elongated wire extending therefrom. The wire has one end with a wire coupler attached. Lastly, a heating element is positionable between the two fabric layers of the body member. The heating element extends from the sleeve through the body member to the cone-like portion. The heating element has a coil coupler projecting from a bottom portion of the body member. The coil coupler couples with the wire coupler of the arm band to provided an electrical power source to the heating element. Whereby, providing power to the heating element raises the temperature of the body member for heating the horn within, when temperatures are below 32° Fahrenheit.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved musical instrument warmer which has all of the advantages of the prior art musical instrument heating and none of the disadvantages.

It is another object of the present invention to provide a new and improved musical instrument warmer which may be easily and efficiently manufactured and marketed.

It is further object of the present invention to provide a new and improved musical instrument warmer which is of durable and reliable constructions.

An even further object of the present invention is to provide a new and improved musical instrument warmer which is susceptible of a low cost of manufacture with regard to both materials and labor, and which accordingly is then susceptible of low prices of sale to the consuming public, thereby making such musical instrument warmer economically available to the buying public.

Still yet another object of the present invention is to provide a new and improved musical instrument warmer which provides in the apparatuses and methods of the prior art some of the advantages thereof, while simultaneously overcoming some of the disadvantages normally associated therewith.

Even still another object of the present invention is to provide a musical instrument warmer for providing covering for warming brass and wood wind type musical instruments in cold weather and further allowing playing of the instruments when covered by the musical instrument warmer.

Lastly, it is an object of the present invention to provide a new and improved musical instrument warmer including a horn in combination with a cover for warming. A warming means is positioned around the horn for heating. The warming means is provided with an electrical power source for activation. Whereby, providing power to the warming means raises the temperature of the warming means for heating the valves when temperatures being below 32° Fahrenheit. The cover has a body member with a front side and a rear side. The body member is formed by attaching two layers of a fabric. The front side of the body member has a cone-like portion projecting outwardly. The body member is adapted to be removably mounted onto the horn when the heating means is positioned on the horn. The body member retains heat generated by the warming means therein, when the warming means is activated.

These together with other objects of the invention, along with the various features of novelty which characterize the invention, are pointed out with particularity in the claims annexed to and forming a part of this disclosure. For a better understanding of the invention, its operating advantages and the specific objectives attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
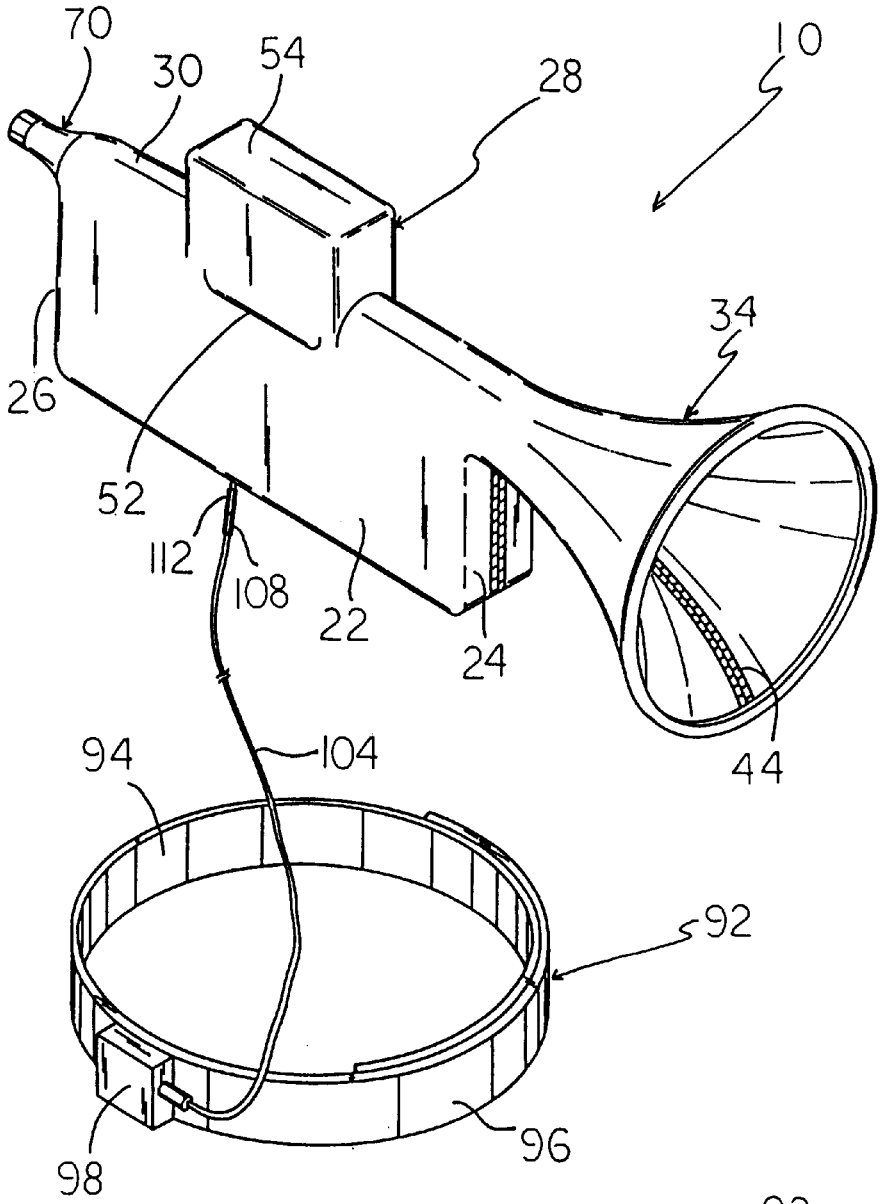
FIG. 1 is a perspective view of the preferred embodiment of the musical instrument warmer constructed in accordance with the principles of the present invention.
Figure 25:
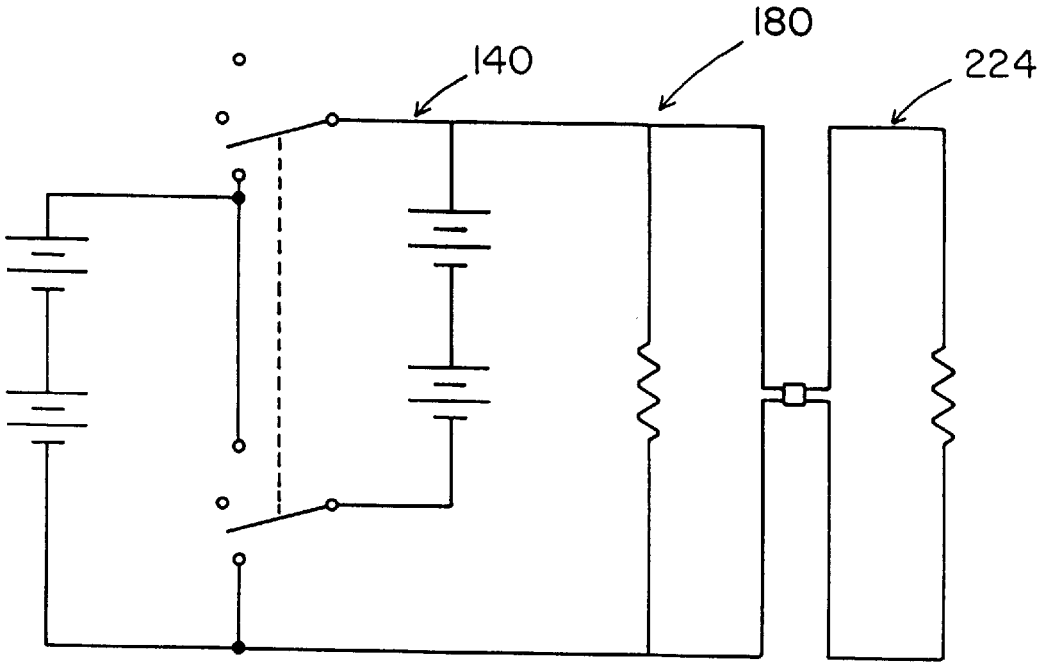
FIG. 25 is the electrical schematic of the heating means and the heating link.

With reference now to the drawings, and in particular to FIGS. 1 and 25 thereof, the preferred embodiment of the new and improved musical instrument warmer embodying the principles and concepts of the present invention and generally designated by the reference numeral 10 will be described.

The present invention, the musical instrument warmer 10 is comprised of a plurality of components. Such components in their broadest context include a horn, a body and a heating means. Such components are individually configured and correlated with respect to each other so as to attain the desired objective.

Figure 5:
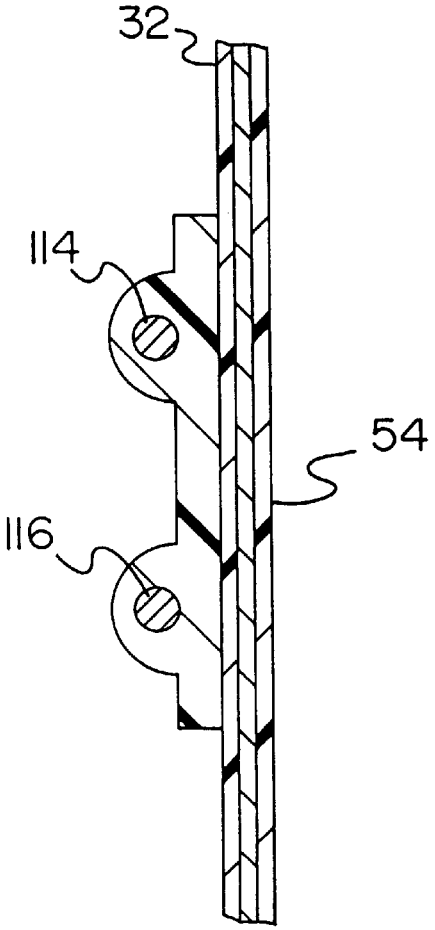
FIG. 5 is a cross sectional view taken along line 5—5 of FIG. 3.
Figure 17:
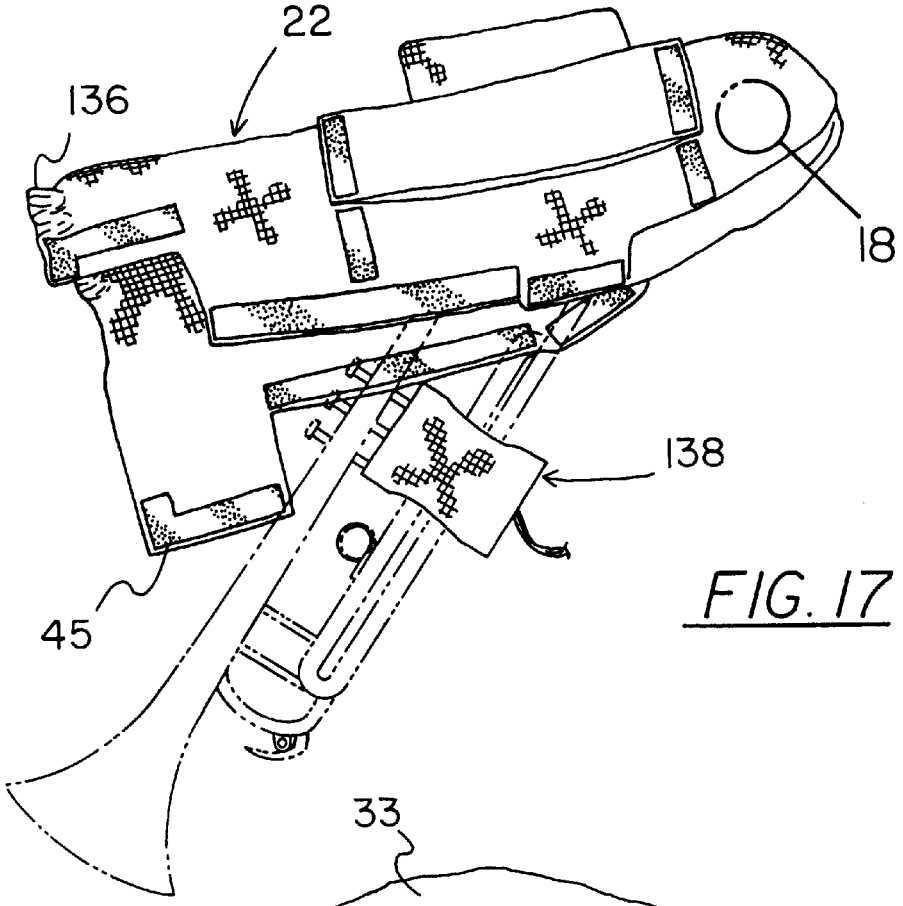
FIG. 17 is a side view of the alternative body member having the horn inserted.
Figure 18:
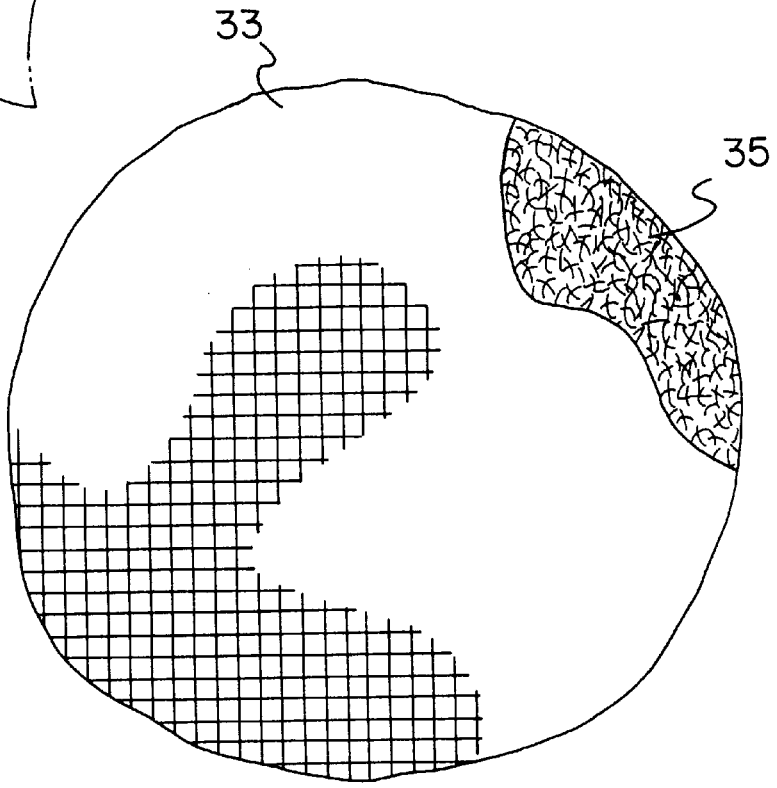
FIG. 18 is an enlarged cross-sectional view of the layers of fabric of the cover of the alternative body member.

Specifically, the present invention includes a brass horn 12 in combination with a cover for warming thereof. The brass horn has a mouthpiece 14 at one end and a bell 16 at another end and an intermediate portion 18 with valves 20. The cover has a generally rectangular body member 22. The body member has a front side 24, a rear side 26 and a generally rectangular projection 28 along a top portion 30. The body member is formed by attaching two layers of a polymeric fabric 32, as seen in FIG. 5. Preferably the polymeric fabric is made from a high performance fiber of the type made from an aromatic polyamide. As an economical alternative the body member may be formed by attaching two layers of fabric made from natural material 35 such as, linen or woven cotton. In this instance, the body member made of the natural fabric has a padding 35 between the two layers as shown in FIG. 18. The body member, when made of a natural fabric fits loosely about the horn, as shown in FIG. 17 and described later in the disclosure. It should be apparent from persons in the art that the body member of this invention may be made of a light weight rigid plastic.

The polyamide fibers, used to make the polymeric fabric for the preferred body member is synthesized through polymerizations, with appropriate aromatic diamine and aromatic acid dichloride, are strong carbon fibers. These fibers may be spun into yarn to make fabric that are higher modulus fabrics designed for plastic reinforcement. The fabric is excellent for use in the present invention because of its dimensional stability over a wide range of temperatures for prolonged periods. These fabrics are lightweight, strong and will not support combustion. The extended usefulness of the high performance fabric makes up for the expense of the fabric in manufacturing. The layers of polymeric fabric are sewn together using threads of the identical material.

Figure 3:
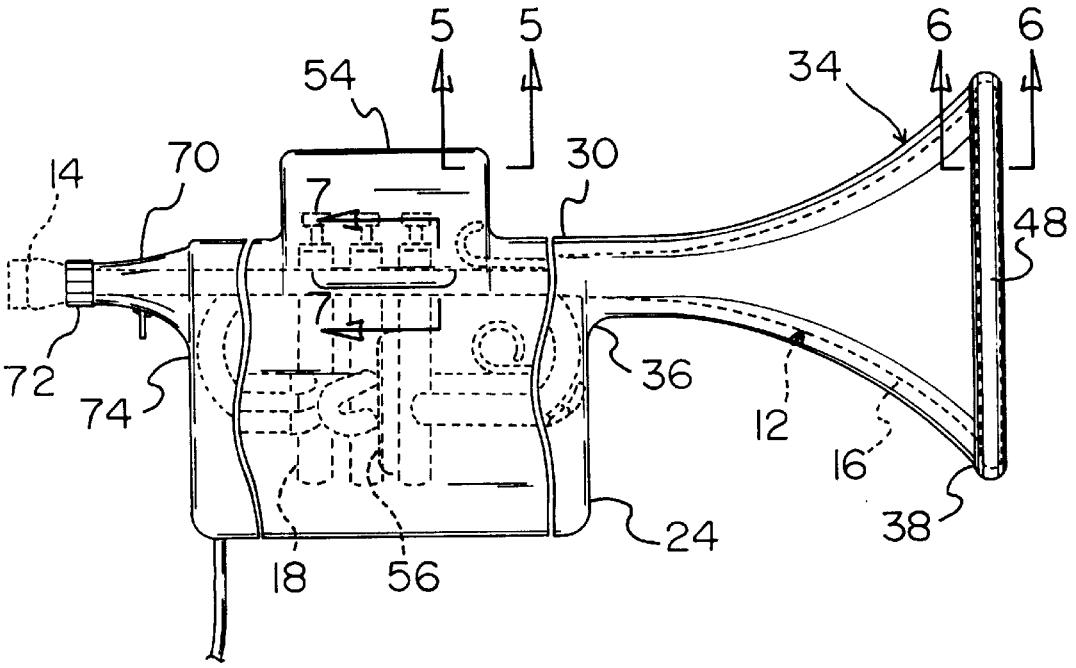
FIG. 3 is a side elevational view of the present invention.

As seen in FIG. 1, the front side of the body member 22 has a cone-like portion 34 projecting outwardly. The cone-like portion, as seen in FIG. 3, has a first portion 36 that is integral the front side 24 and the top portion. The cone-like portion has a free portion 38 that is capable of allowing air to pass therethrough and into a hollow interior (not shown) of the rectangular body member.

Figure 4:
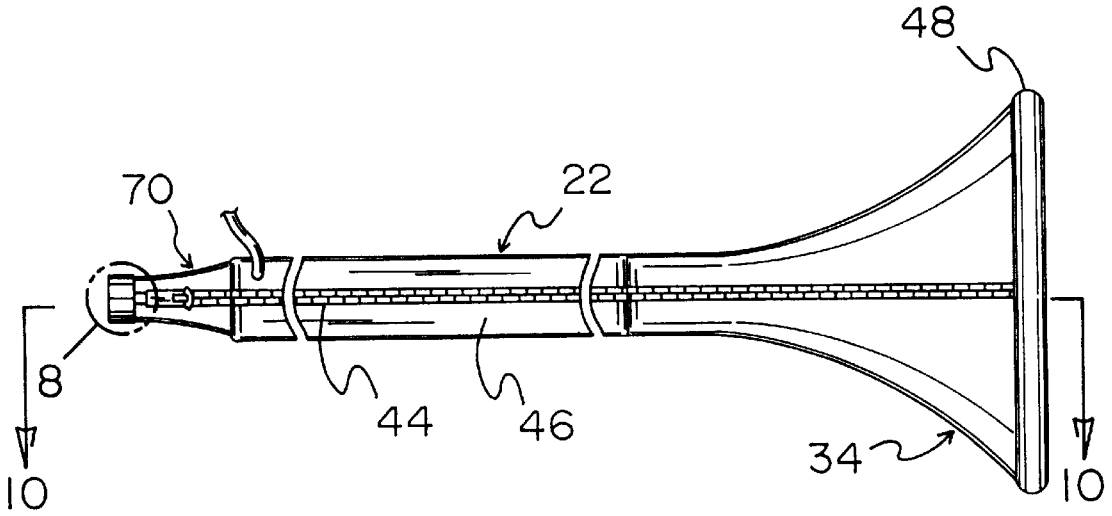
FIG. 4 is bottom plan view of the present invention of FIG. 1.
Figure 6:
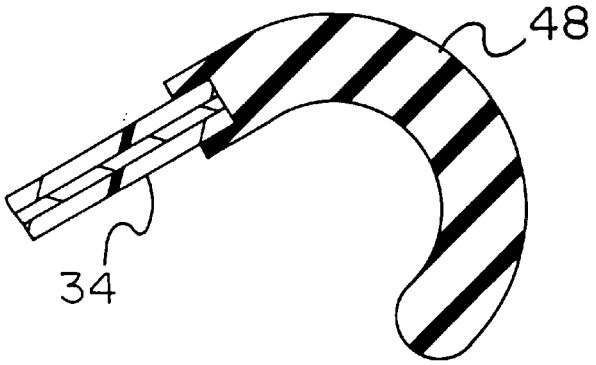
FIG. 6 is a cross sectional view taken along line 6—6 of FIG. 3.

The body member 22 is adapted to be removably mounted onto a brass horn having a generally identical shape. As illustrated in FIG. 4, the body member is sealed with a zipper-type fastener 44. The zipper type fastener may be plastic or metal. The zipper is positioned along the bottom portion 46 of the body member. It is to be under stood that the body member may be sealed with a pile-type fastener member 45, as an alternative to a zipper and as shown in the body member of FIG. 17. The cone-like portion 34 has an elasticized rim member 48, as shown in FIG. 6. The rim member is integral the free portion of the cone-like portion and is positionable about the bell 16 of the horn. The rectangular projection 28 is positionable over the valves of the instrument. When the rectangular body member and cone-like portion completely cover the horn, operation of the valves 20 for playing is possible.

Figure 7:
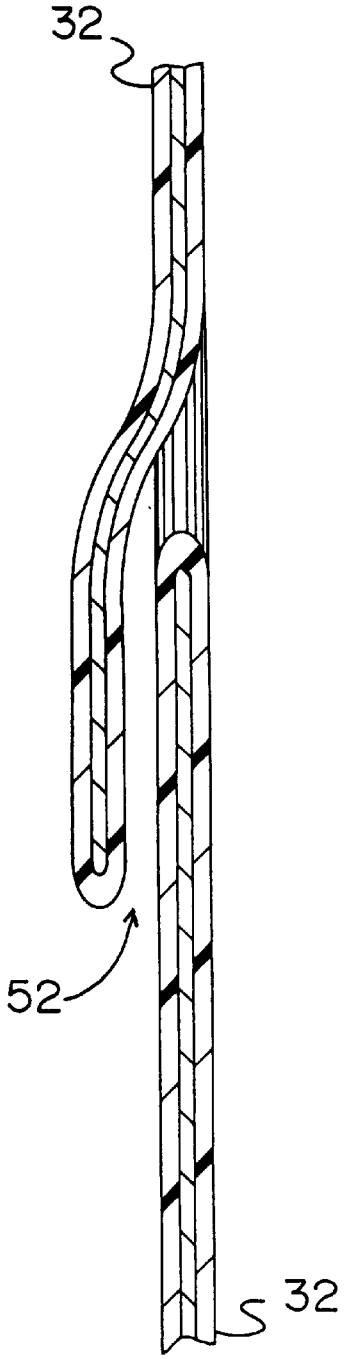
FIG. 7 is a cross sectional view taken along line 7—7 of FIG. 3.
Figure 10:
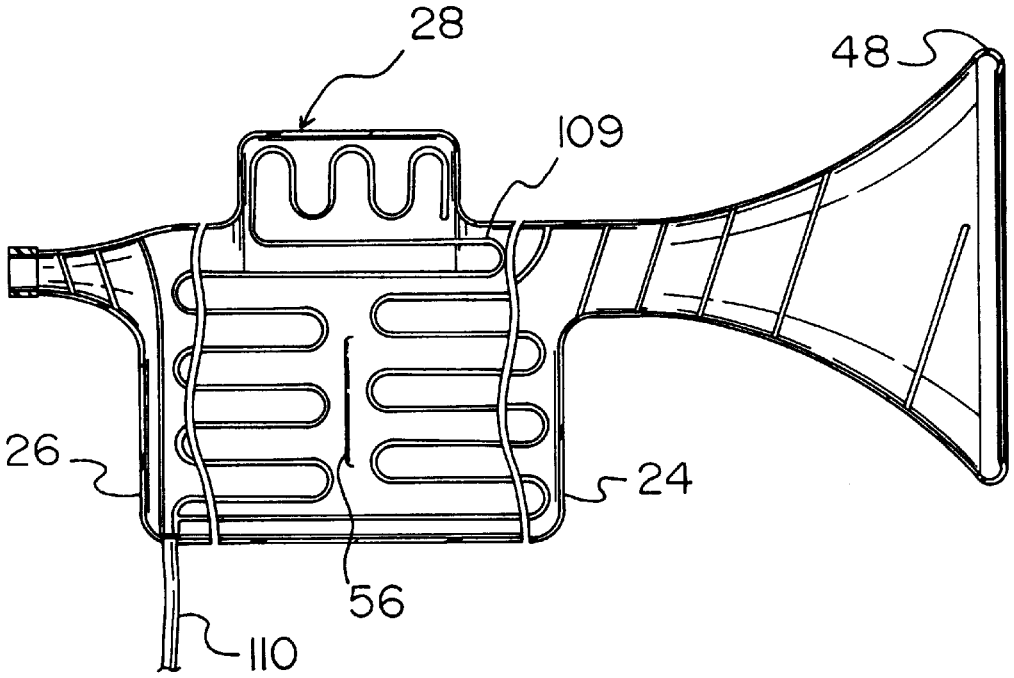
FIG. 10 is a cross sectional view of the present invention taken along line 10—10 of FIG. 4.

A horizontal slit 52, as shown in FIG. 7, allows access to the valves. The slit is spaced from the projection top 54. A vertical slit 56 is provided. The vertical slit is spaced from the tip of the projection, on the opposite side of the horizontal slit. The vertical slit allows the horn player to hold the instrument. In FIGS. 1 and 3, the horizontal slit is depicted on the right side of the rectangular body member. In FIGS. 3 and 10, the vertical slit is depicted on the left side of the rectangular body member. It is to be realized that both slits may be placed on either side of the body member to accommodate left or right handed players.

Figure 9:
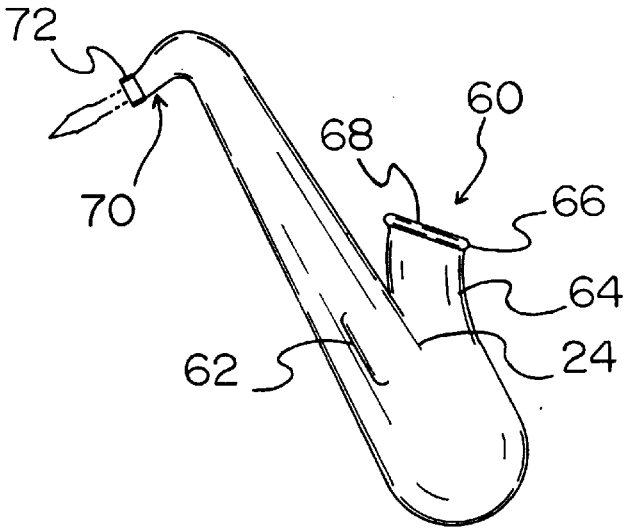
FIG. 9 is an alternative embodiment of the musical instrument warmer constructed in accordance with the principles of the present invention.

Also, the body member of the musical instrument warmer may be elongated and generally J-shaped 60. The horn in this instance is selected from the family of wood wind instruments that have right and left finger and palm key groups. The J-shaped body member has a vertical slit 62 on both sides. As shown in FIG. 9, when the body member has this structure a generally cylindrical portion 64 is integral the front side 24. The cylindrical portion has a free portion 66 with an elasticized rim member 68. The rim member of the cylindrical portion fits around the edge of the bell 16 of the instrument in the same manner as that of the cone-like portion. The free portion allows air to pass therethrough and into a hollow interior of the body member when not in use. When the free portion is positioned about the bell of the instrument, it allows the operation of the instrument. The J-shaped body member 60, when positioned over the right and left finger and palm key group of the instrument, allows the operation thereof.

The above shapes of the body member of the present invention is not limiting. The musical instrument warmer for brass and wood wind instruments may be elongated. When the musical instrument warmer is elongated it has an increasing diameter from top to bottom. When the body member has this shape the musical instrument is still operational.

Figure 8:
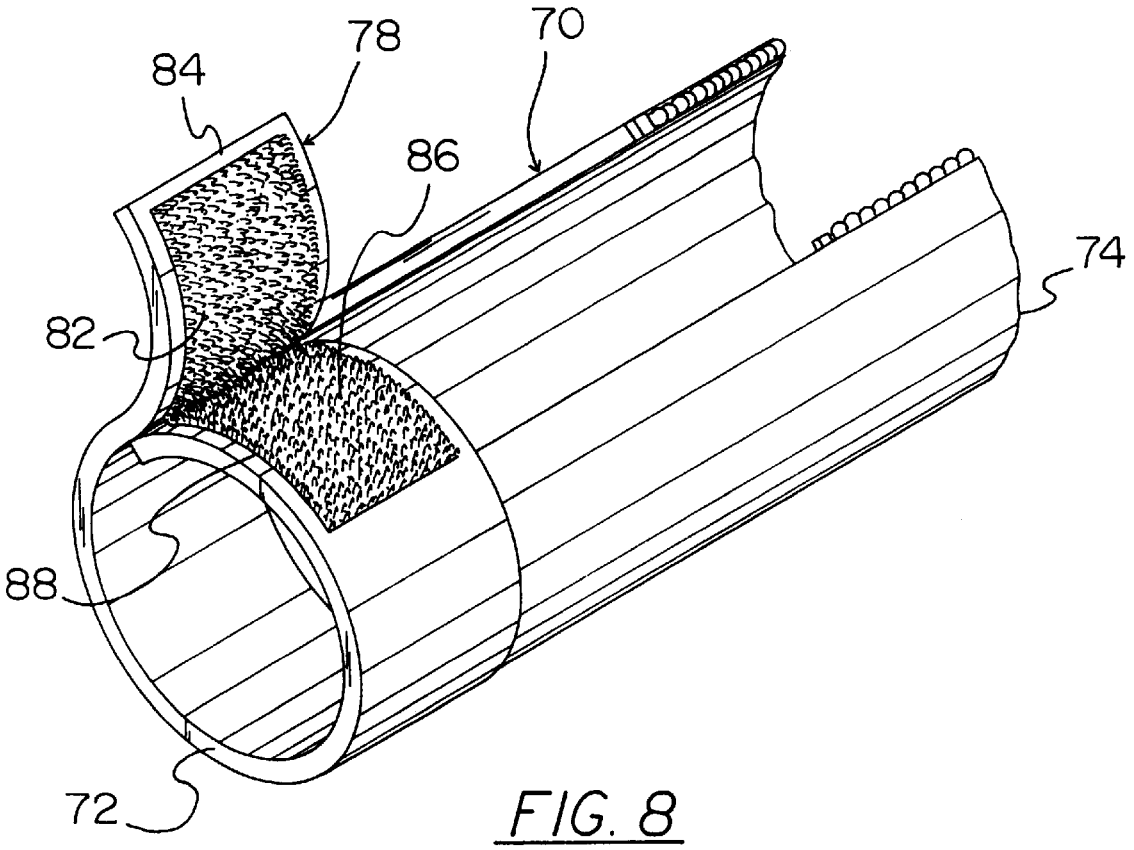
FIG. 8 is an enlarged cut-away view of the sleeve of the present invention taken at position 8 of FIG. 4

As best illustrated in FIG. 3, a sleeve portion 70 is provided. The sleeve portion is positionable adjacent the mouthpiece 14 of either instrument, the brass horn or wood wind, when the cover is in position. The sleeve portion will not obstruct the horn's natural playing mechanism. The sleeve portion has a first end 72 and a second end 74 integral the rear side 26 and the top portion 30 of the body member. The sleeve portion, as shown in FIG. 8, has a flap 78 that is capable of opening and closing. The flap has a pile type fastener 82 adjacent an interior edge 84. The flap has a pile type faster 86 adjacent a complementary exterior edge 88 and capable of coupling with the pile type fastener of the interior edge. The sleeve covers the mouth of the instrument. The sleeve remains in position when the body member is placed onto the instrument. The sleeve portion is the same on all the various body member shapes of the present invention.

Figure 2:
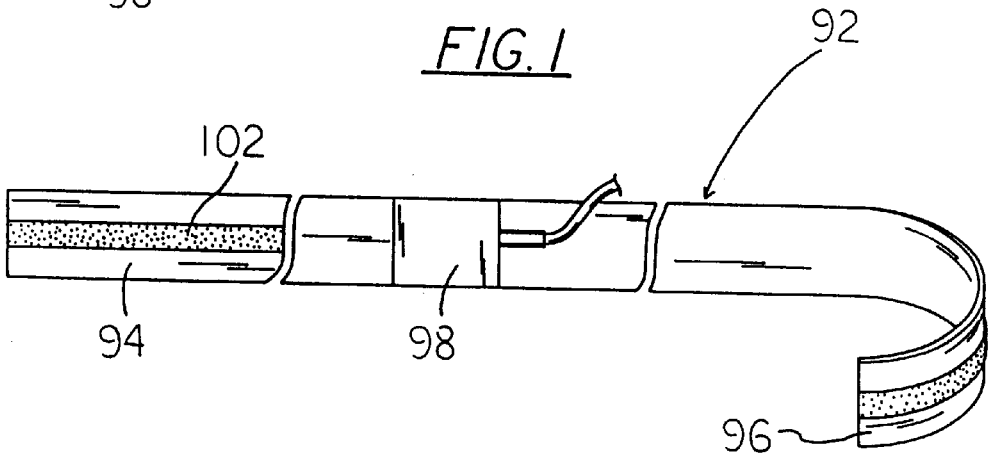
FIG. 2 is a linear view of the arm band of FIG. 1 and showing it's functional components.

Additionally, an arm band 92 is included. The arm band may be formed of any fabric that is strong and durable. The arm band has an interior side 94 and an exterior side 96. The exterior side has a housing 88 fixedly attached. FIG. 2 shown that each side of the arm band has a strip of a pile-type fastener material 102 adhered thereto. The pile-type fastener is used for coupling the opposite ends of the arm band. The housing has a source of electrical power (not shown) located within. The housing has an elongated wire 104 extending therefrom, as seen in FIG. 1. The wire has one end with a wire coupler 108 attached. The arm band of the present invention is not limiting. A wrist band or a waist band would serve the same purpose as the arm band.

Figure 11:
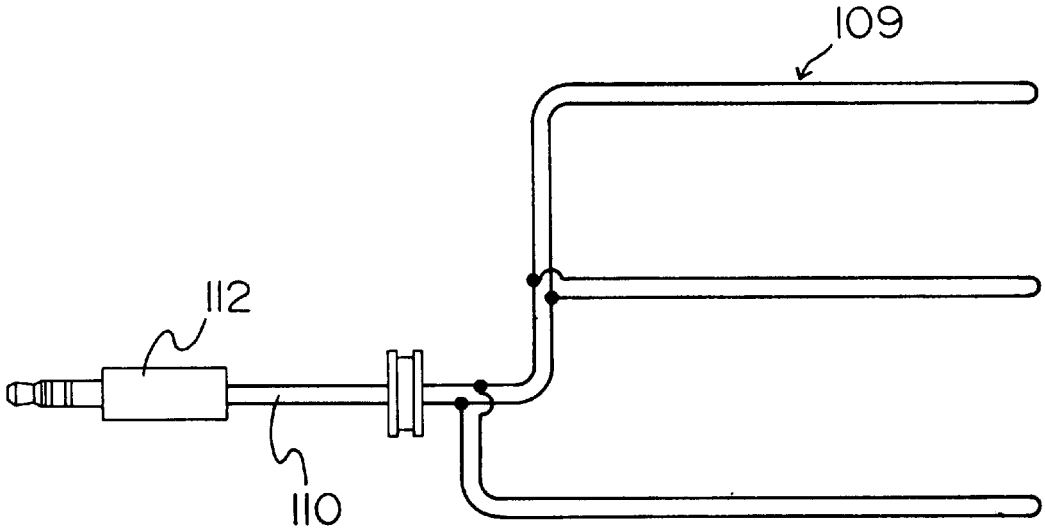
FIG. 11 is an enlarged cut-away view of one portion of the heating element of FIG. 10.

A heating element 109, as shown in FIG. 11, is provided. The heating element is positioned between the two fabric layers 32 of the body member. The heating element extends from the sleeve 70 through the body member 22 and 60 to the structure covering the bell 16 of the brass horn or wood wind instrument. The structure may be the cone-like portion, cylindric portion, or the elongated member. The heating element has a wire 110 with a coil coupler 112 projecting from a bottom portion 46 of either body member. The wire is presently depicted coming from the bottom portion of the rectangular body member. The coil coupler couples with the wire coupler 108 of the arm band 92 and provides an electrical power source to the heating element. The polyamide fabric used to make the musical instrument warmer decomposes at relatively high temperatures (800° F. to 900° F.).

Figure 12:
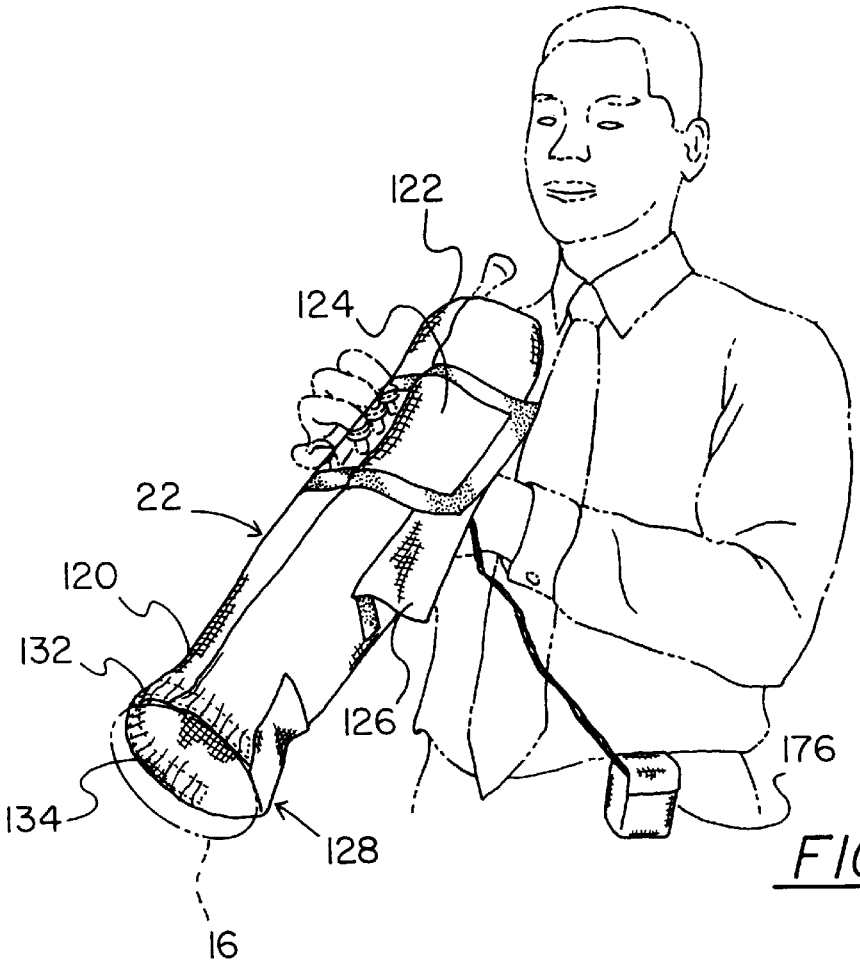
FIG. 12 is a perspective of the present invention with the alternative body member in an operable orientation.

As stated in a preceding paragraph, the body member 22 may be made from natural fabrics that are more economical and provide an alternative. The body member made from the alternative fabric forms an alternative body member. The alternative body member is a generally rectangular body member of the cover. The alternative body member has a front side 120, a rear side 122, a generally rectangular upper flap 124 along a top portion, and a generally rectangular side flap 126. The alternative body member is formed by attaching two layers of a natural fabric 35. The front side of the body member has a cone-like portion 128 that projects outwardly from the front side. The cone-like portion has a first portion 132 that is integral the front side and the top portion. The cone-like portion has a free portion 134 that is capable of allowing air to pass therethrough and into a hollow interior of the body member. The cone-like portion of the alternative body member continues to have an elasticized rim member 136 integral the free portion. As seen in FIG. 12, the rim member is positionable about the bell 16 of the horn.

Figure 13:
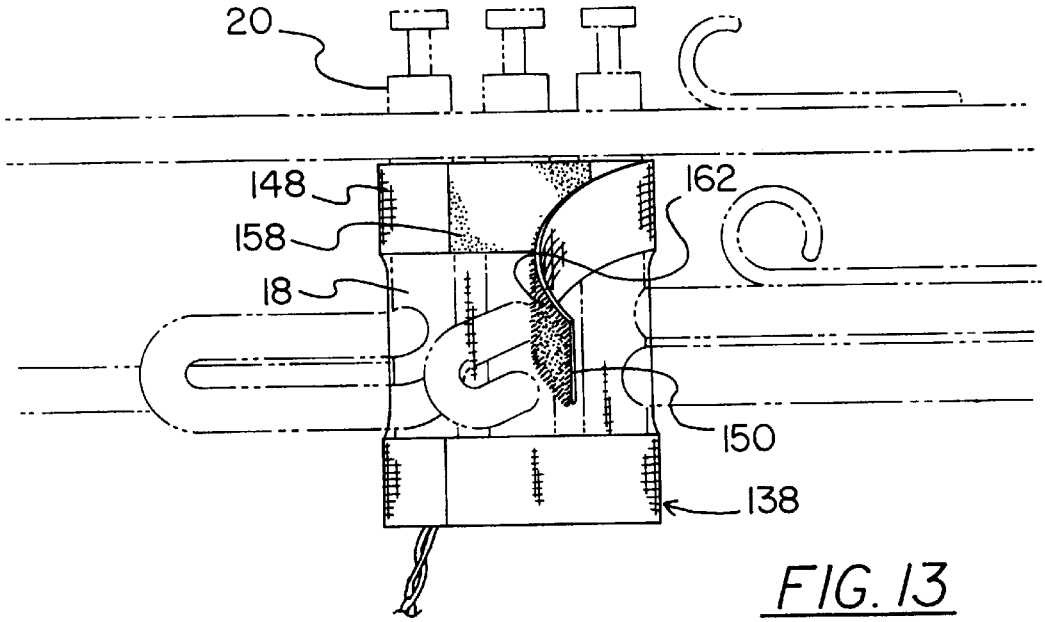
FIG. 13 is an enlarged view of the warming means in an operable orientation.
Figure 14:
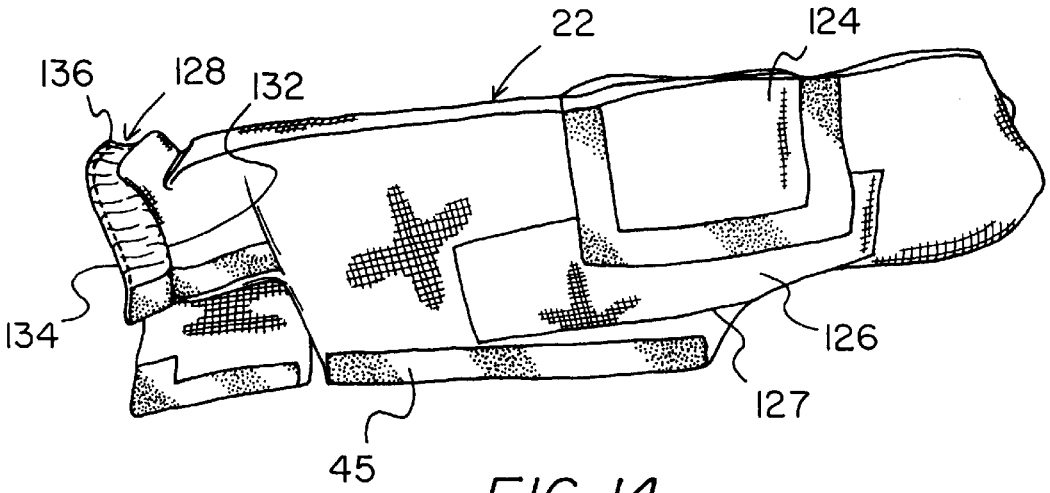
FIG. 14 is an isometric view of the alternative body member of FIG. 12.
Figure 15:
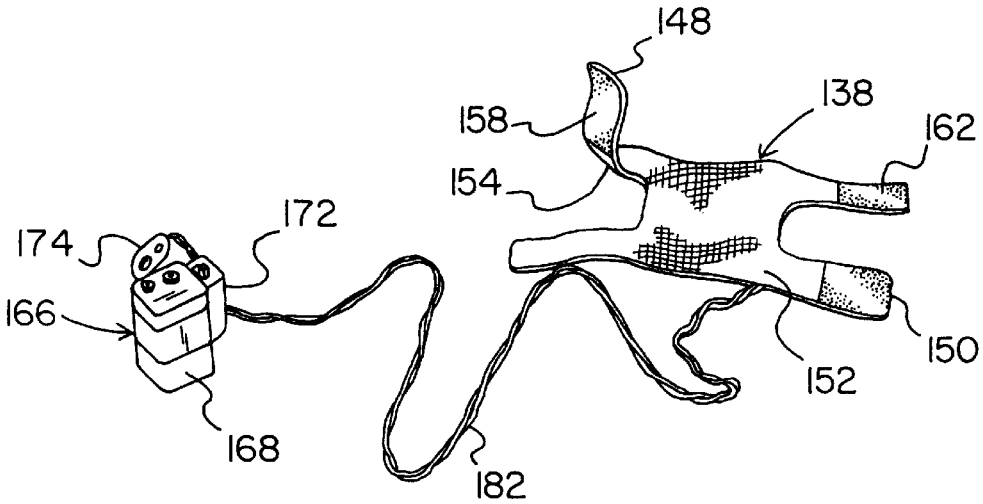
FIG. 15 is perspective view of the warming means and the power pack.
Figure 19:
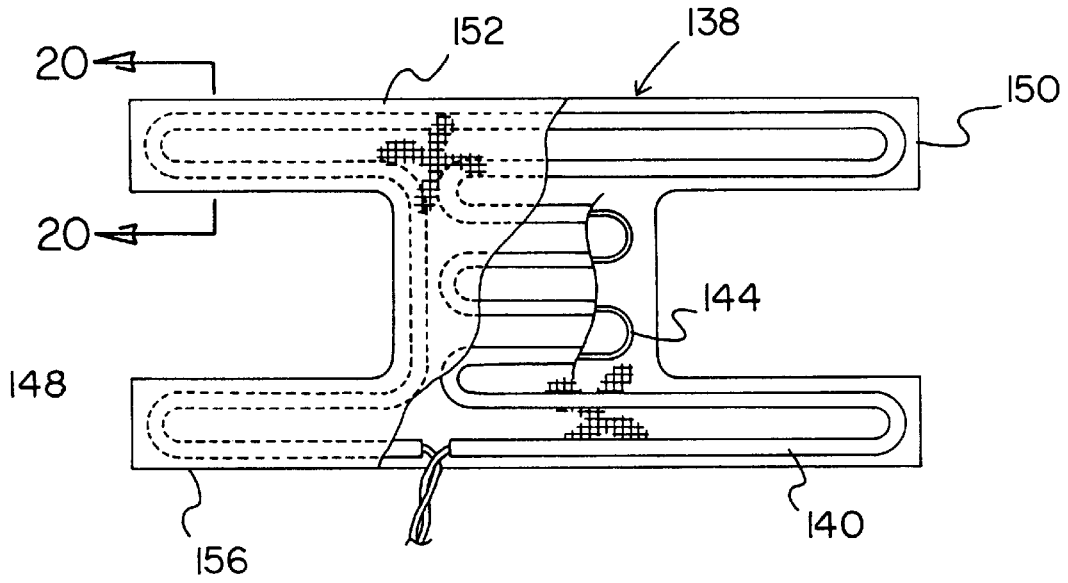
FIG. 19 is a cut-away cross-sectional view of the heating means of FIG. 15.
Figure 20:
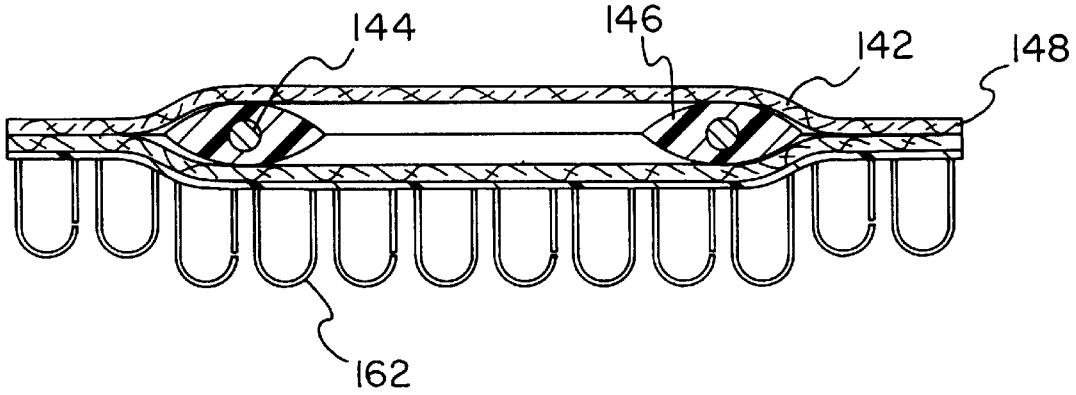
FIG. 20, is a cross-sectional view of the heating means taken along line 20—20 of FIG. 19.

Also, an H-shaped warming means 138 is provided. The warming means of FIG. 15 is formed by a heating element 140 enclosed in two layers of fabric 142. The heating element of FIG. 19 is identical to the heating element of FIG. 11. Each has a wire 144 encased in a wire covering 146, as depicted in FIG. 20, that allows heat to be expelled. The warming means has a plurality of extensions projecting from a main portion that form a first two extensions 148 and a second two extensions 150. The warming means having a top side 152, a bottom side 154 and a peripheral edge 156 therearound. The top side of the first two of the plurality of extensions has a pile type fastener member 158 attached. The bottom side of the second two of the plurality of extensions has a pile type fastener member 162 attached for coupling the first two of the pair of extensions. As shown in FIGS. 13 and 17, the H-shaped warming means is positioned around the intermediate portion of the horn, with the first two extensions coupled to the second two extensions, for heating the valves 20. FIG. 20 is an enlarged view of the hooks and loops of the pile type fastener members used on the warming means.

Figure 16:
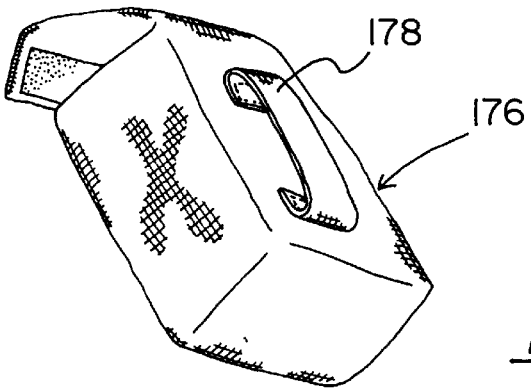
FIG. 16 is an isometric view of the case for the power pack of FIG. 15.
Figure 24:
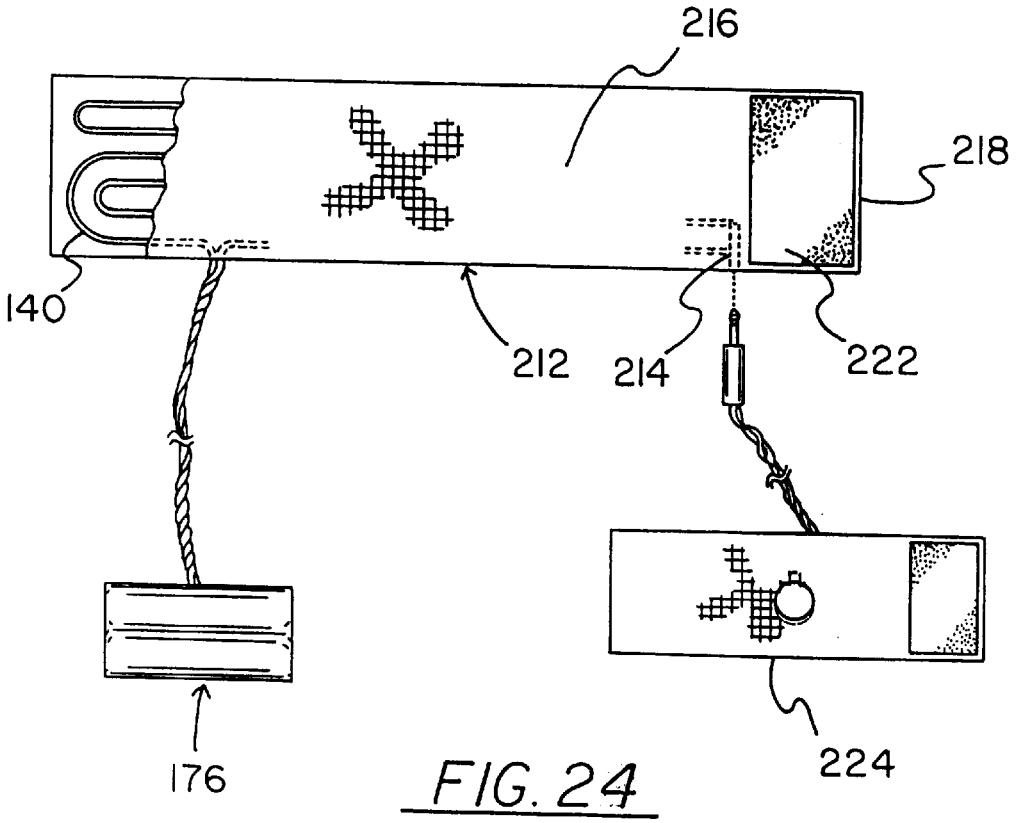
FIG. 24 is a top view of the rectangular heating means of the present invention.

Included is a power pack 166. The power pack supports a battery 168. A switch mechanism 172 with a coupler 174 is an integral component of the power pack. A case 176 for the power pack is provided. The case may be square, as seen in FIG. 15, or it may be flat as shown in FIG. 24. As seen in FIG. 16, the case has a belt loop 178 for coupling onto the belt of the horn player during use of the H-shaped warming means. The heating element could be powered by a two-level power source 180

FIG. 25 shows the electrical schematic for the two-level power source. In use the switch is a double-pole double-throw switch with a third position for "off". When the switch is in the "Low" position the batteries are connected in parallel. When the switch is in the "Hi" position the batteries are connected in series. The heat that will be provided in the low is one-quarter of the heat provided in hi. The power is proportional to the square of the voltage applied.

The wires of the heating element 140 of the H-shaped warming means are coil wires 182. The coil wires project from the peripheral edge 156 of the warming means 138. The coil wires being coupled with the switch mechanism 172 of the power pack, as seen in FIG. 15. The power pack provides an electrical power source to the heating element for activating the warming means. Whereby, providing power to the heating element raises the temperature of the warming means for heating the valves 20 when temperatures is below 32° Fahrenheit.

The alternative body member, as shown in FIG. 17, is adapted to be removably mounted onto the horn when the H-shaped heating means is coupled to the intermediate portion 18. The coil wires project from under the side flap 126 of the body member 22 or from the bottom portion. The coil wires may be shortened to accommodate placement of the battery pack within one of the interior pockets of the alternative body member. The side flap forms a horizontal slit 127 on another side for allowing the horn to be held for playing. The cone-like portion is positionable about the bell of the horn while allowing the operation of the horn. When the upper flap is closed over the valves of the horn a horizontal slit may be formed to allow access to the valves of the horn for allowing the operation of the valves. The body member is capable of retaining heat generated by the warming means when positioned over the horn with the warming means activated.

The heating elements 109 and 140 will keep the instrument within a temperatures ranging from 50° F. to 70° F.

These temperatures are well below the decomposition temperatures of the fabric. The temperatures of the heating element will never raise above a temperature safe to touch. Whereby, providing power to the heating element raises the temperature of the body member for heating the brass horn or woodwind instrument within when temperatures being below 32° Fahrenheit.

Figure 21:
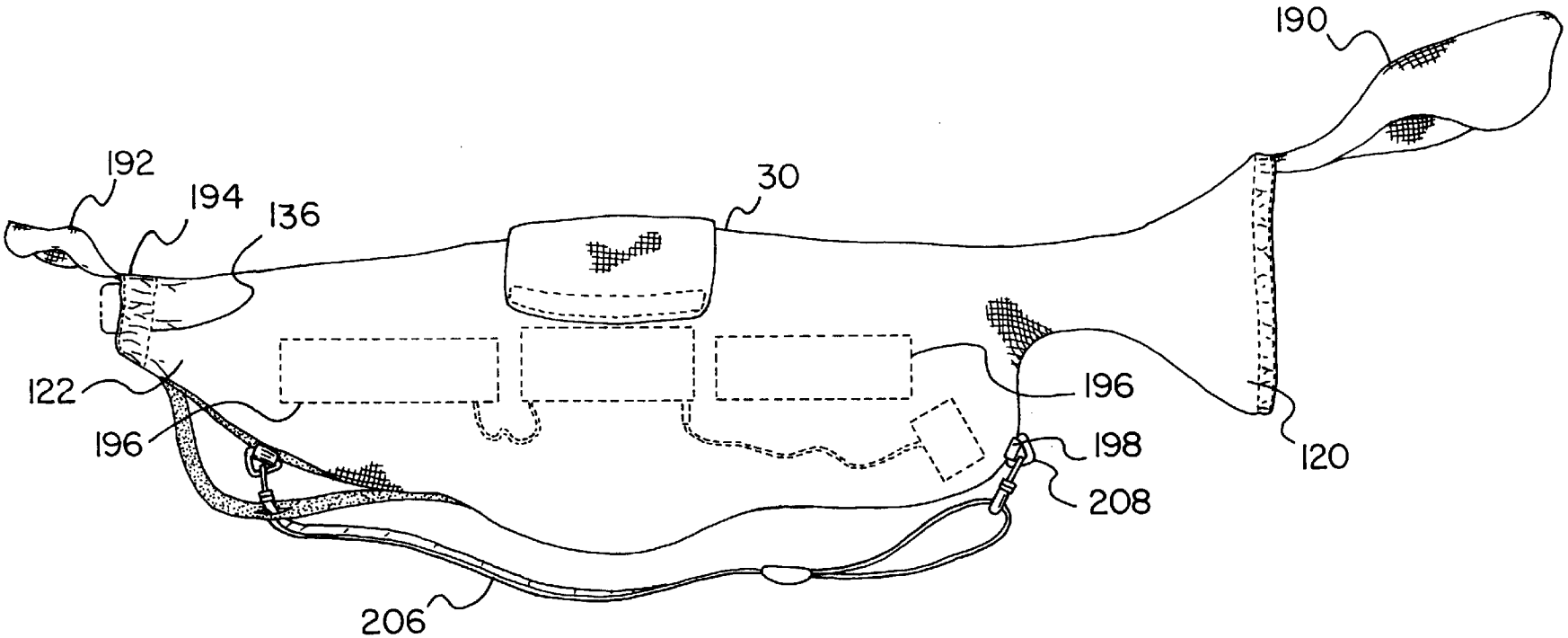
FIG. 21 is a side view of the alternative body member of the present invention having a strap.

The alternative body member may be formed to have a bell flap 190 and a mouth piece flap 192, as shown in FIG. 21. The additional flaps will allow the alternative body member to completely encase the brass or woodwind instrument. The bell flap is integral the cone-like portion 128 near the rim member 136 of the alternative body member. The bell flap couples to the front side 120 with a pile-type fastener member 45. The bell flap is used to close the free portion 134.

The sleeve portion 194 of the alternative body member is positionable adjacent the mouthpiece 14 of the horn. The sleeve portion has the elastic rim 136 integral the rear side 122 of the body member and the top portion 30. The sleeve portion has the mouth piece flap interconnected thereto. The bell flap of the cone-like portion and the mouth piece flap encases the brass horn within the body member. The mouth piece flap is integral the rear side 122 and has a pile-type fastener member. The mouth piece flap covers the mouth piece of the instrument.

Figure 23:
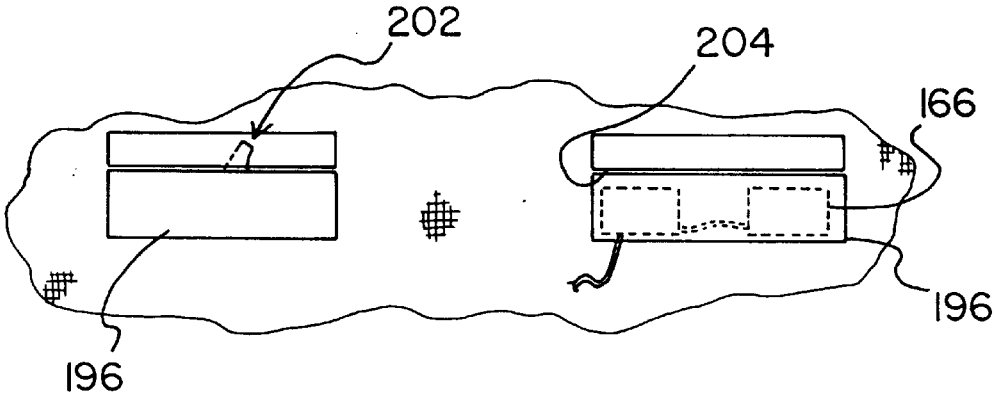
FIG. 23 is a cut-away view of the interior of the body member showing the pockets.

Additionally, the alternative body member is supplied with a plurality of interior pockets 196 and a pair of loop members 198. The interior pockets are sized to receive the case 176 and accessories 202 for the instrument. To fit within the pocket the case must be in the flat form. Such accessories may include a mouth piece, valve oil and a music layer. Each pocket has a slit 204 for an opening, as depicted in FIG. 23.

The pair of loop members are attached to the alternative body member along the bottom portion 46 of the body member. One of the loops is coupled near the front side and adjacent the body portion where fastening of the body member occurs, while the other of the pair of loops is coupled near the rear end. An elongated strap 206 is provided. The elongated strap is coupled to the loop members of the alternative body member by a pair of release clips 208. The elongated strap is use to transport the instrument encased within the alternative body member.

Figure 22:
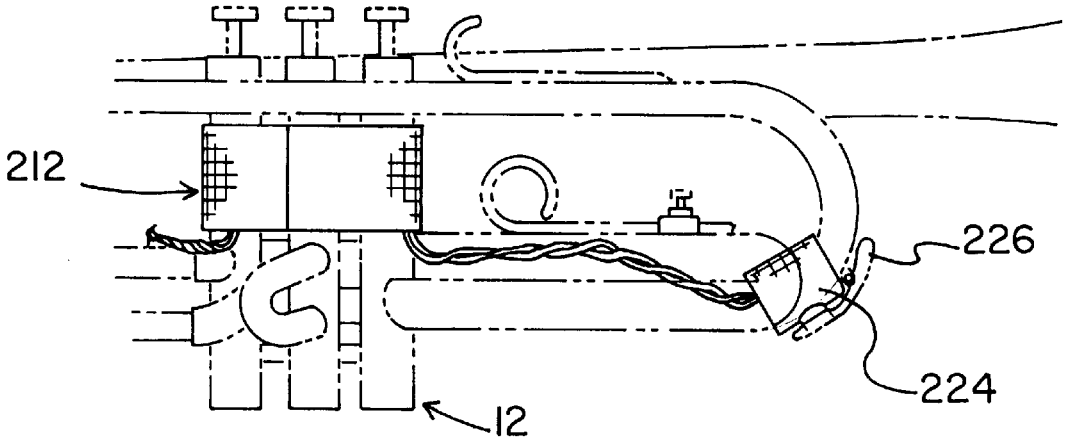
FIG. 22 is perspective view of the heating means and the heating link of the present invention.

As best illustrated in FIG. 24, the warming means 212 may have a rectangular shape. The rectangular warming means is formed by a heating element 140 enclosed in two layers of fabric. The heating element has a female socket member 214. The fabric is identical to the fabric used in the H-shaped warming means. The heating element of FIG. 24 is identical to the heating element of FIG. 11. Each has a wire 144 encased in a wire covering 146, as depicted in FIG. 20, that allows heat to be expelled. The warming means having a top side 216 and a peripheral edge 218 therearound. The top side of the warming means has a pile type fastener member 222 that will couple with an unseen a pile type fastener member of the bottom side for coupling the rectangular means around the valves of the horn 12 as shown in FIG. 22.

Finally, a heating link 224 is provided. The heating link shown in FIG. 24, is identical to the rectangular warming means 212. The heating link does not have a female socket member, instead it has a male plug. The male plug for couples with the female socket member of the heating means. The heating link is sized to be positioned around the spit valve 226 of the horn.

The musical instrument warmer of the present invention is portable and easily used by the musician. The present invention keeps brass and woodwind instruments warm during playing time in cold temperatures. The instrument warmer, when not in use as a warmer, can be used as a rain repellent and carrying case. Generally air column vibrational instruments are warmed by the breath and the hand of the musician during play. When temperatures fall below freezing the instrument's pitch or sound will go flat, sharp or become impossible to play. The present invention provides a light weight covering that is combined with a heating element.

The heating element regulates the temperature of the instrument during play. The present invention when placed over the instrument, does not interfere with the musicians ability to play the instrument. The present invention allows the instrument to retains its tone and clarity when playing in freezing temperatures. The heating element is powered by a battery that is held in the housing of the arm band or other supporting structure. The housing for the battery may be attached to the musical instrument warmer's that are structured to cover large instruments, such as tubas. The musical instrument warmer comes in a variety of sizes and shapes. Also, the housing of the power source of the heating is not limited to being held within the arm band. The instrument warmer can be structured to have a wrist band or waist band that will hold the source of power. Because the arm band contains the heating source, it may be use with any of the musical instrument warmers without removal.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A musical instrument warmer system for use with brass horn and wood wind instruments comprising in combination:

a cover for warming the brass horn the brass horn having a mouthpiece at one end and a bell at another end and an intermediate portion with valves;

a generally rectangular body member of the cover having a front side, a rear side and a generally rectangular projection along a top portion thereof, the body member being formed by attaching two layers of a polymeric fabric, the front side of the body member having a cone-like portion projecting outwardly therefrom, the cone-like portion having a first portion being integral the front side and the top portion, the cone-like portion having a free portion being capable of allowing air to pass therethrough and into a hollow interior of the body member;

the body member being removably mounted onto the brass horn having a generally identical structure, the body member having a horizontal slit on one side and a vertical slit on another side for allowing playing of the horn, the cone-like portion being positionable about the bell of the horn while allowing the operation of the horn, the rectangular projection being positionable over the valves of the horn while allowing the operation of the valves;

a sleeve portion being positionable adjacent the mouthpiece of the horn, the sleeve portion having a first end and a second end integral the rear side of the body member and the top portion, the sleeve portion having a flap being capable of opening and closing, the flap having a pile type fastener adjacent an interior edge thereof, the flap having a pile type faster adjacent a complementary exterior edge thereof and capable of coupling with the pile type fastener of the interior edge;

an arm band having an interior side and an exterior side with a housing fixedly attached thereto, the housing being capable of having a source of electrical power located within, the housing having an elongated wire extending therefrom, the wire having one end with a wire coupler attached thereto; and a heating element being positionable between the two fabric layers of the body member, the heating element extending from the sleeve through the body member to the cone-like portion, the heating element having a coil coupler projecting from a bottom portion of the body member, the coil coupler being capable of coupling with the wire coupler of the arm band for providing an electrical power source to the heating element, whereby providing power to the heating element raises the temperature of the body member for heating the brass horn within when temperatures being below 32° Fahrenheit.

2. A musical instrument warmer system comprising:

a cover for warming a horn;

a body member of the cover having a front side, a rear side and a top portion thereof, the body member being formed by attaching two layers of a polymeric fabric, the body member being removably mounted onto the horn;

a sleeve portion having a first end and a second end integral the rear side of the body member and the top portion, the sleeve portion being positionable adjacent a mouthpiece of the horn;

an arm band having an exterior side with a housing having a source of electrical power, the housing having a wire with a wire coupler extending therefrom; and a heating element being positionable between the two fabric layers of the body member, the heating element having a coil coupler projecting from a bottom portion of the body member and coupling with the wire coupler of the arm band for heating the horn when electrical power passes thereto.

3. The musical instrument warmer as set forth in claim 2, wherein the body member being generally rectangular and having a generally rectangular projection extending from the top portion, and the front side of the rectangular body member having a cone-like portion integral thereto and projecting outwardly therefrom.

4. The musical instrument warmer as set forth in claim 3 wherein the rectangular body member having a horizontal slit spaced from a top of the projection, and a vertical slit spaced on an opposite side of the rectangular body member and spaced from the top of the projection.

5. The musical instrument warmer as set forth in claim 4, wherein the cone-like portion having a free portion being capable of allowing air to pass therethrough and into a hollow interior of the rectangular body member.

6. The musical instrument warmer as set forth in claim 5, wherein the cone-like portion being positionable about the bell of the horn while allowing the operation of the horn, and the rectangular projection being positionable over the intermediate portion and valves of the horn while allowing the operation of the valves.

7. The musical instrument warmer as set forth in claim 2, wherein the body member being elongated and generally J-shaped, the J-shaped body member having a vertical slit on either side thereof and a generally cylindrical portion integral the front side.

8. The musical instrument warmer as set forth in claim 7, wherein the cylindrical portion having a free portion being capable of allowing air to pass therethrough and into a hollow interior of the body member.

9. The musical instrument warmer as set forth in claim 8, wherein the cylindrical portion being positionable about the bell of the wood wind while allowing the operation of the instrument, and the body member being positionable over a right and a left finger and palm key group of the wood wind while allowing the operation thereof.

10. The musical instrument warmer as set forth in claim 2, wherein the sleeve portion having a flap being capable of opening and closing around the mouth piece of the instrument.

11. The musical instrument warmer as set forth in claim 10, wherein the flap of the sleeve having a pile type fastener adjacent an interior edge thereof, and the flap having a pile type faster adjacent a complementary exterior edge thereof and capable of coupling with the pile type fastener of the interior edge.

12. The musical instrument warmer as set forth in claim 2, wherein the arm band having an interior side being capable of coupling with the exterior side when in operation.

13. The musical instrument warmer as set forth in claim 12, wherein the housing being fixedly attached to the exterior side of the arm band with the wire extending therefrom and towards the body member.

14. The musical instrument warmer as set forth in claim 2, wherein the heating element extending from the sleeve through the body member to the portion of the body member covering the bell of the horn.

15. The musical instrument warmer as set forth in claim 2, wherein the coil coupler of the heating element coupling the wire coupler of the arm band provides the electrical power source to the heating element that raises the temperature of the body member and heating the brass horn within when temperatures being below 32° Fahrenheit.

16. A musical instrument warmer system comprising in combination:

a cover for warming a horn;

a warming means being positioned around the horn for heating, the warming means provided with an electrical power source for activation thereof, whereby providing power to the warming means raises the temperature of the warming means for heating the valves when temperatures being below 32° Fahrenheit; and a body member of the cover having a front side and a rear side, the body member being formed by attaching two layers of a fabric, the front side of the body member having a cone-like portion projecting outwardly therefrom, the body member being removably mounted onto the horn when the heating means positioned on the horn, the body member retaining heat generated by the warming means therein when the warming means being activated.

17. A musical instrument warmer system comprising in combination:

a cover for warming a horn;

a generally rectangular warming means for positioning around an intermediate portion of the horn for heating, the warming means having a heating link coupled thereto, the heating link for positioning around a spit valve, the warming means provided with an electrical power source for activation thereof, whereby providing power to the warming means raises the temperature of the warming means for heating the valves when temperatures being below 32° Fahrenheit;

a generally rectangular body member of the cover having a front side, a rear side and a generally rectangular projection along a top portion thereof, the body member being formed by attaching two layers of a fabric, the front side of the body member having a cone-like portion projecting outwardly therefrom, the cone-like portion having a first portion being integral the front side and the top portion, the cone-like portion having a free portion being capable of allowing air to pass therethrough and into a hollow interior of the body member, the free portion of the cone-like portion having a bell flap;

the body member being removably mounted onto the brass horn having a generally identical structure, the body member having a horizontal slit on one side and a vertical slit on another side for allowing playing of the horn, the cone-like portion being positionable about the bell of the horn while allowing the operation of the horn, the rectangular projection being positionable over the valves of the horn while allowing the operation of the valves;

a sleeve portion being positionable adjacent the mouthpiece of the horn, the sleeve portion having a first end integral the rear side of the body member and the top portion, the sleeve portion having a mouth piece flap, the bell flap of the cone-like portion and the mouth piece flap encases the brass horn within the body member; and an elongated strap having a pair of release clips for coupling with a pair of loop members of the body member for carrying the body member with the horn encased by the bell flap and the mouth piece flap.

18. The musical instrument warming system as set forth in claim 17, wherein the heating means having a female socket member and the heating link having a male plug for coupling with the female socket member of the heating means.

19. The musical instrument warming system as set forth in claim 17, wherein the body member having a plurality of pockets attached to an interior thereof, and one of the pockets being sized for receiving the electrical power source therein.

* * * * *